US007150597B2

(12) United States Patent
Lee

(10) Patent No.: US 7,150,597 B2
(45) Date of Patent: Dec. 19, 2006

(54) METHOD FOR MANUFACTURING DESIGN TAB END USING PILOT HOLE OF TAB COIL

(75) Inventor: Do Hee Lee, Seoul (KR)

(73) Assignee: 3C Technologies Ltd., Tortola (VG)

( * ) Notice: Subject to any disclaimer, the term of this patent is extended or adjusted under 35 U.S.C. 154(b) by 110 days.

(21) Appl. No.: 10/491,022

(22) PCT Filed: Sep. 25, 2002

(86) PCT No.: PCT/KR02/01805

§ 371 (c)(1),
(2), (4) Date: Mar. 25, 2004

(87) PCT Pub. No.: WO03/041891

PCT Pub. Date: May 22, 2003

(65) Prior Publication Data

US 2004/0253078 A1 Dec. 16, 2004

(30) Foreign Application Priority Data

Sep. 25, 2001 (KR) ..... 2001-59438

(51) Int. Cl.
*B21D 51/44* (2006.01)

(52) U.S. Cl. ..... 413/14; 413/12; 413/13

(58) Field of Classification Search ..... 220/269, 220/906; 413/3, 12, 18, 14–25
See application file for complete search history.

(56) References Cited

U.S. PATENT DOCUMENTS 4,380,129 A * 4/1983 Barrash ..... 40/307
5,741,105 A * 4/1998 Schubert et al. ..... 413/25
6,105,806 A * 8/2000 Stasiuk ..... 220/269

* cited by examiner

*Primary Examiner*—Ricardo J. Palabrica
*Assistant Examiner*—Hung C. Le
(74) *Attorney, Agent, or Firm*—Lee, Hong, Degerman, Kang & Schmadeka

(57) ABSTRACT

The present invention relates to a method for manufacturing a design tab end using a pilot hole of a tab coil. The method includes punching a pilot hole on a tab coil in the same pitch as that of tab forming pitch of a conversion press prior to design printing, washing and drying the tab coil, inputting the tab coil into a printer according to the pitch of the pilot hole, detecting the pilot hole of the tab coil inputted into the printer, printing the design on the tab coil using a print roll which is controlled by the color controller, pulling and winding the design-printed tab coil according to the pitch of the pilot hole, loading the design tab coil on an uncoiler of a conversion press, tab forming the design tab and attaching the design tab onto a shell supplied into the conversion press.

4 Claims, 3 Drawing Sheets

METHOD FOR MANUFACTURING DESIGN TAB END USING PILOT HOLE OF TAB COIL

FIELD OF THE INVENTION

The present invention relates to a method for manufacturing a designed tab end using a pilot hole of a tab coil, and more particularly, to a method for manufacturing a designed tab end using a pilot hole of a tab coil which can precisely print a design on a target position of the tab formed on a beverage can.

CROSS-REFERENCE TO RELATED APPLICATIONS

Pursuant to 35 U.S.C. § 119(a), this application claims the benefit of earlier filing date and right of priority to International Application No. PCT/KR02/001805, filed on Sep. 25, 2002 and Korean Application No. 2001-59438, filed on Sep. 25, 2001, the contents of which are hereby incorporated by reference herein in their entirety.

BACKGROUND OF THE INVENTION

A beverage can is generally used with the advantages that the beverage is able to be preserved for a long period of time and it can be used easily, and the beverage can is used for containing soda water, fruit beverage, mixed beverage as well as beer. The beverage can is generally comprised of a cylindrical body made of metallic material such as steel or non-iron metallic material such as aluminum, and an aluminum end seamed on the upper side of the body. The aluminum end is formed with a score line so that the opening of the beverage can is torn easily. Further, a tab for opening the beverage can by pushing the score line is joined on the end.

In order to drink the contents in the beverage can, the score line formed on the end has to be torn by pulling the tab. Then, the beverage in the can is discharged from the outlet formed by the torn score line, so a man can drink the beverage conveniently.

The present invention is related to the manufacturing method for manufacturing a designed tab end of the beverage can that can function as an ornament by applying a design on the tab joined on the end, where the design includes a logo of the beverage brand, an image, advertising words, a suggestive word about the property of the product, a variety of animation characters for the promotion of the product, a caricature of a figure, an image of a fruit in case of a fruit beverage, a logo and a mascot of a sports game, or a logo and a trademark of a company.

As an example of a method of manufacturing a designed tab end, in beverage cans, Korean Patent Application No. 2001-8020 filed and published by the same assignee on Feb. 17 2001 discloses a method for manufacturing a designed tab end by carrying out a tab base color painting process on a tab coil, carrying out a design applying process and a varnishing process and putting the tab into a tab formation process and a conversion pressing process, a stacking process, using a pitch aligning device.

Also, Korean Patent Application No. 10-2001-43268 filed by the same assignee on Jul. 18 2001 discloses a design printing phase adjusting apparatus using a print roll tolerance sensor.

In the above designed tab end formation and manufacturing methods, a design to be printed on the tab coil must be printed in the same interval as the tab formed in a conversion press after the printing process, so that the printed design can be precisely positioned on a sealed-head portion of a target finger hole.

However, in the process of printing a design on the tab coil, fine errors in the intervals of design prints are gradually increased from the initial stage of printing due to the tolerance between prints and the tolerance of a print cylinder roll. Thus, when printing a design of more than a predetermined length, the position of print is deviated from an allowable range, thereby lowering the value of a product. Also, the tab coil must be arranged and put into a conversion press, which may require a long period of time to manufacture a tab.

In a pilot hole for a tab coil and a design printing phase controller without a guide such as a pilot hole in design printing phase alignment and tab formation using the same, after printing a design on a tab coil with a length of several kilometers, the position of the printed design is deviated from the target position of the formed tab when forming the tab coil of more than a predetermined length.

SUMMARY OF THE INVENTION

Therefore, it is an object of the present invention to provide a method for manufacturing a designed tab end using a pilot hole of a tab coil in which a pilot hole is previously punched prior to the printing process, a corresponding design is printed precisely on a target position using a pilot hole sensor and a gear set to the pitch of the pilot hole, remove a pilot punch from a conversion molding set, form a tab according to a previously punched interval by applying only the pilot pin, and print a desired design precisely on the target position of the tab head portion.

The present invention provides a method for manufacturing a designed tab end using a pilot hole of a tab coil, which can print a design precisely on the upper surface of a tab for opening a discharge outlet of a beverage can and attach the tab on the can, comprising the steps of: punching a pilot hole on a tab coil in the same pitch as that of a conversion press prior to design printing; flatly reforming a projected portion formed on the bottom of the punched tab coil; washing and drying the tab coil; inputting the tab coil into a printer according to the pitch of the pilot hole; detecting the pilot hole of the tab coil inputted into the printer; controlling a color controller so that a design can be printed on the detected target position of the tab coil; printing the design on the tab using a print roll controlled by the color controller; pulling the design-printed coil according to the pitch of the pilot hole; drying the design-printed coil in order to input it into the varnish coating process; winding the resulting design tab coil; loading the wound design tab coil on an uncoiler of a conversion press for tab formation and then inputting it into the conversion press at a predetermined speed; forming the designed tab coil fed to the conversion press as a tab forming mold set; and attaching a shell supplied into the conversion press to the design tab formed after the second shell processing of the conversion press.

Preferably, in the tab formation step, a tab is formed in the same pitch as the pitch punched in the pilot hole punching press by a pilot pin left after removing a pilot punch from the tab forming mold set.

Figure 1:
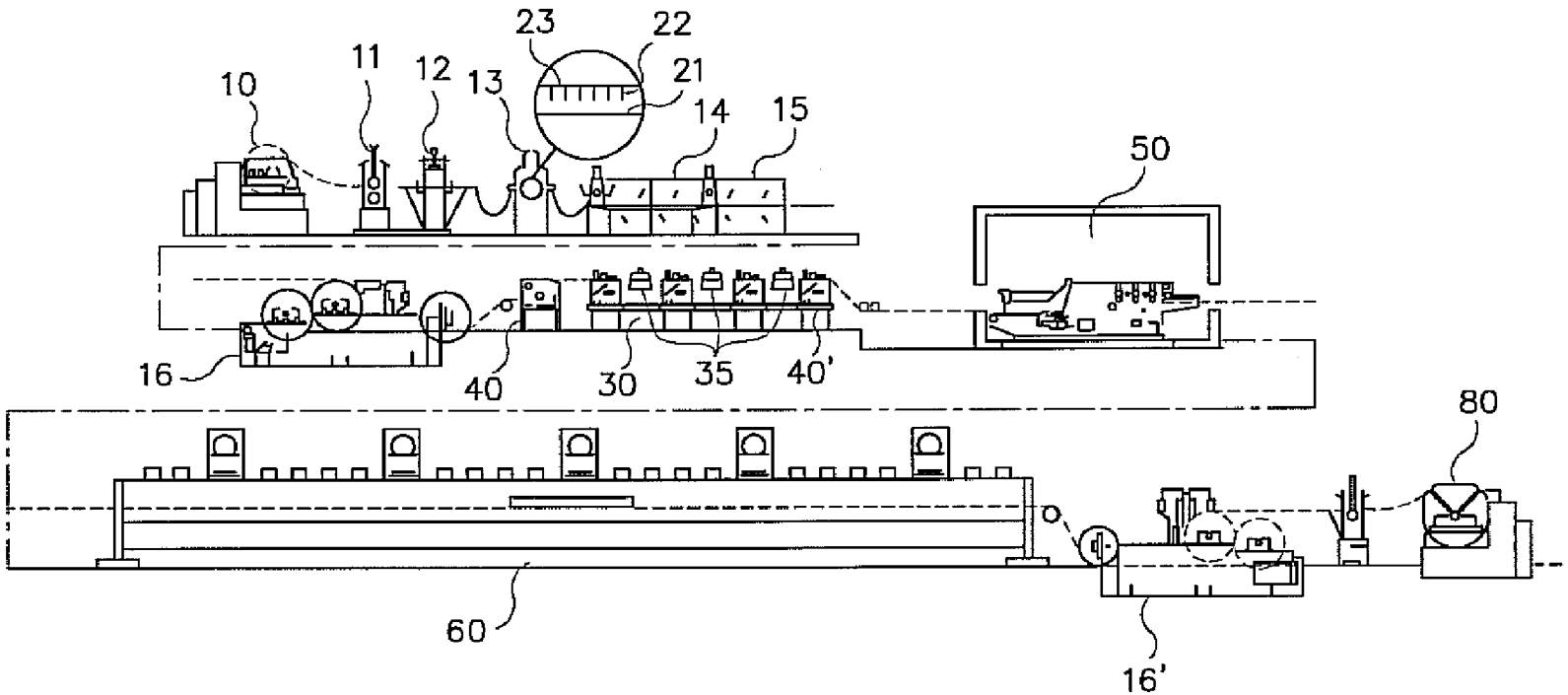
FIG. 1 is a side view illustrating an apparatus for manufacturing a designed tab end using a pilot hole of a tab coil according to a preferred embodiment of the present invention.

*Explanation of reference numerals for main elements of the drawings*

| | |
|---|---|
| 10: uncoiler | 11: tab coil feeder |
| 12: tab coil connector | 13: pilot hole punching press |
| 14: washer | 15: drier |
| 16, 16': infeeding and outfeeding tensioners | 21: pilot hole punch |
| 22: pilot pin | 23: reform punch |
| 30: design printer | 31: register punch |
| 32: register controller | 33: phase alignment motor |
| 34: gear box | 35: printing roller |
| 36: offset roller | 37: clean roller |
| 40, 40': infeeder, outfeeder | |

DETAILED DESCRIPTION OF THE PREFERRED EMBODIMENT

Figure 2:
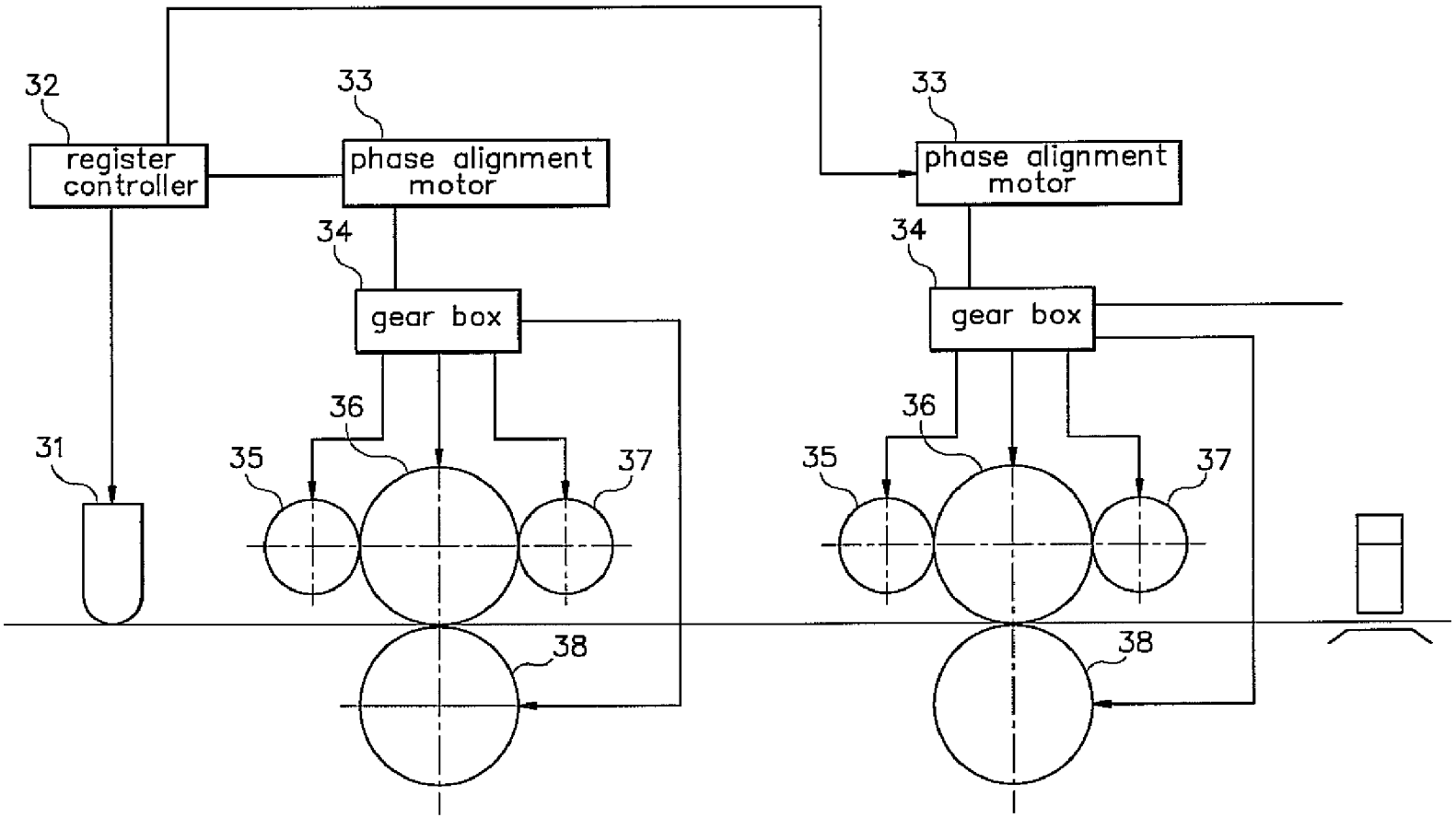
FIG. 2 is a view showing a design print phase alignment device using the pilot hole of the tab coil according to the preferred embodiment of the present invention.

FIG. 1 is a side view illustrating an apparatus for manufacturing a designed tab end using a pilot hole of a tab coil according to a preferred embodiment of the present invention; and FIG. 2 is a view showing a design print phase alignment device using the pilot hole of the tab coil according to the preferred embodiment of the present invention.

Referring to these drawings, before performing a printing process, a tab coil is mounted on an uncoiler 10 and is wound in a roll shape in order to precisely make the pitches of design printing and tab formation the same. The roll shaped tab coil is inputted into a pilot hole punching press 13 through a tab coil feeder 11 at a predetermined speed, thus punching a pilot hole with a predetermined shape and a predetermined interval.

At this time, in order to continuously print the tab coil, before inputting the tab coil into the pilot hole punching press 12, two coils are connected by a tab coil connector 12 and then are continuously inputted into a pilot hole punching press 13.

From the viewpoint of one-lane tab formation, the pilot hole punching press 13 is provided with a tab coil pilot hole punching mold set, being consisted of a pilot punch 21, a plurality of pilot pins 22 positioned in a continuous straight line and a reform punch 23 for flattening a protruded portion that may be formed on the bottom of a tab coil punched by the above-mentioned pilot punch 21. At this time, the pilot hole punch 21, each of the pilot pins 22 and the reform punch 23 are plurally provided in parallel according to the number of lines of the tab coil to be printed.

The tab coil punched by the pilot hole punching press 13 is washed by a washer 14 and is dried by a dryer 15, and thereafter is inputted into a design printer 30 for printing process, thus printing a design on the tab coil.

At this time, in order to apply the printed design in the process of forming a tab by a conversion press, a pilot hole is detected by a pilot hole sensor 31 so that a finger hole portion can be positioned precisely on a flat seamed head portion of the tab.

A print phase alignment device includes a register controller 32 for allowing a design to be printed at a precise position when the position of the pilot hole is detected, a printing roller 36 for driving a gear in a gear box 34 upon receipt of a control signal of the register controller 32, and a phase alignment motor 33 for aligning the target position of a design to be printed with the precise position between the pre-punched pilot holes by rotating or reverse rotating an offset roller 37.

At the same time, in order to print a target design on a tab coil at a predetermined interval using the above-mentioned pilot hole, a meshed type infeeder 40 used right before the design printing step and a meshed type outfeeder 40' used right after the design printing step are interlocked with each of printing rollers.

Meanwhile, for obtaining a plurality of design colors of more than one figure, the surface of the tab coil is dried by a drier 35 after each printing process is completed, and then a color printing process is performed. After the design printing process is completed, a varnish coating process with a varnish coating machine 50 is performed on the surface of the tab coil and then a drying process with a drying furnace 60 for hardening the printed surface is performed thereon, in order to minimize the generation of a scratch on the design during formation, transfer and distribution.

After the drying process is completed, the tab coil printed with a design is kept to have a constant tensile force by an outfeeding tensioner 16', is outputted at the same height all the time by a deflector roll 70 and is wound again by a winder 80. Thereafter, it is mounted on an uncoiler of a conversion press for the purpose of tab formation and then a tab is formed by the conversion press.

At this time, the design printed on the tab coil is positioned at a target portion of the tab all the time to thus form the tab, so that the pilot hole of the tab coil, which is previously punched by a pilot hole punching press 13 before the printing process without performing the pilot punching process of the conversion press, can be located in the same position as in tab formation by a pilot pin 22 of the conversion press.

Also, a plurality of pilot pins are provided, so that the pilot hole of the tab coil, which is previously punched by a pilot hole punching press 13 before the printing process without performing the pilot punching process of the conversion press, can be located in the same position as in tab formation of the conversion press.

The method for manufacturing a designed tab end using a pilot hole of a tab coil according to the preferred embodiment of the present invention will now be described with reference to the accompanying drawings.

Figure 3:
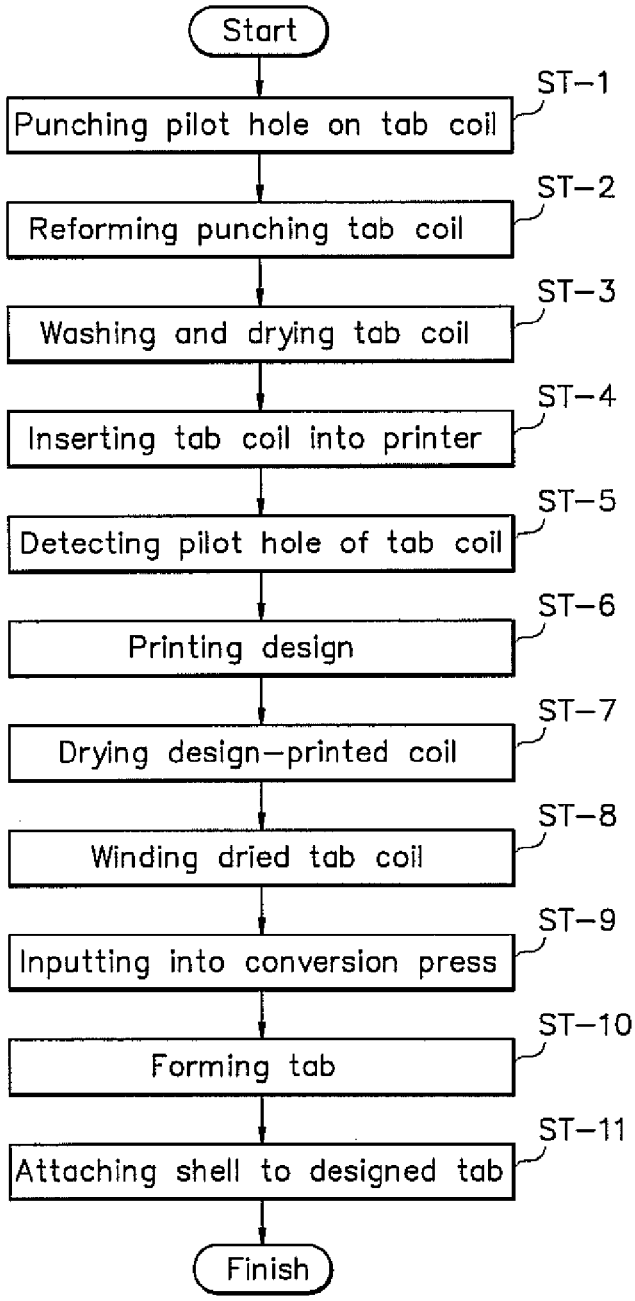
FIG. 3 is a flow chart showing a method for manufacturing a designed tab end using a pilot hole of a tab coil according to the preferred embodiment of the present invention.

FIG. 3 is a flow chart showing a method for manufacturing a designed tab end using a pilot hole of a tab coil according to the preferred embodiment of the present invention.

Firstly, in the method for manufacturing a designed tab end using a pilot hole of a tab coil, a pilot hole is punched on a tab coil in the same pitch as that of a conversion press before design printing (a first step: ST-1).

Then, a projected portion formed on the bottom of the punched tab coil is reformed flatly (a second step: ST-2).

After the reforming, the tab coil is washed and dried (a third step: ST-3).

The dried tab coil is inputted into a printer 30 according to the pitch of the pilot hole (a fourth step: ST-4). The pilot hole of the inputted tab coil is detected (a fifth step ST-5).

A printing process is performed on the detected target position of the tab coil. In this printing process, a color controller is controlled so that a design can be printed on the detected target position of the tab coil and a design printing is performed by a print roll controlled by the color controller (a sixth step: ST-6).

After the printing, a design-printed coil is pulled according to the pitch of the pilot hole and the coil is dried in order to input the design-printed coil into the varnish coating process (a seventh step: ST-7).

Then, the dried tab coil is wound (an eighth step: ST-8).

For formation of the tab coil, the wound designed tab coil is loaded on the uncoiler of a conversion press and then is inputted into the conversion press at a predetermined speed (a ninth step: ST-9).

The designed tab coil fed into the conversion press is formed as the tab forming mold set. A tab is formed in the same pitch as the punched pitch in the pilot hole punching press by a pilot pin left after removing a pilot punch from the tab forming mold set (a tenth step: ST-10).

And, a shell supplied to the conversion press is attach to the designed tab formed after the second shell processing of the conversion press (an eleventh step: ST-11).

Meanwhile, although the preferred embodiment of the present invention has been described, it will be understood by those skilled in the art that the present invention should not be limited to the described embodiment, but various changes and modifications can be made within the spirit and the scope of the present invention.

INDUSTRIAL APPLICABILITY

In the method for manufacturing a designed tab end using a pilot hole of a tab coil according to the present invention, it is possible to prevent the deviation of the design position from a target position during tab formation due to the accumulation of tolerances in a printing work by punching a pilot hole on a tab coil in the same pitch as in the tab formation process of the conversion press in the initial stage process prior to design printing. Particularly, it is possible to prevent production interruption due to the realignment of the tab coil by processing the pilot hole on the previously punched tab coil in the same way as in the printing process and the tab formation process of the conversion press. Accordingly, the present invention enables a fine design printing and prevents the reduction of productivity due to work interruption.

What is claimed is:

1. A method for manufacturing a designed tab end using a pilot hole of a tab coil such that a design is precisely printed on an upper surface of the designed tab, the designed tab adapted to open a discharge outlet of a beverage can, the method comprising the steps of:

punching a pilot hole on a tab coil in a same pitch as that of a conversion press prior to design printing;

flatly reforming a projected portion formed on the punched tab coil;

washing and drying the tab coil;

inputting the tab coil into a printer according to the pitch of the pilot hole;

detecting the pilot hole of the tab coil;

controlling a color controller such that a design is printed on a detected target position of the tab coil;

printing the design on the tab coil using a print roll controlled by the color controller;

pulling the tab coil according to the pitch of the pilot hole;

drying the tab coil;

subjecting the tab coil to a varnish coating process;

winding the varnished tab coil;

loading the wound tab coil on an uncoiler of a conversion press for tab formation and inputting the tab coil into the conversion press;

forming the tab coil as a tab forming mold set; and attaching a shell to the tab coil.

2. The method of claim 1, further comprising forming a tab in the same pitch as the punched pilot hole using a pilot pin left after removing a pilot punch from the tab forming mold set.

3. A method for manufacturing a design tab end using a pilot hole of a tab coil such that a design is precisely printed on the surface of the design tab, the design tab adapted to open a discharge outlet of a beverage can, the method comprising the steps of:

punching a pilot hole on a tab coil in a same pitch as that of a tab forming pitch of a conversion press prior to design printing;

washing and drying the tab coil;

inputting the tab coil into a printer according to the pitch of the pilot hole;

detecting the pilot hole of the tab coil;

printing a design on the tab coil using a print roll controlled by a color controller;

pulling and winding the tab coil according to the pitch of the pilot hole;

loading the tab coil on an uncoiler of a beverage packaging lid making conversion press;

tab forming the design tab; and attaching the design tab onto a shell supplied to the conversion press.

4. The method of claim 3, further comprising forming a tab is in the same pitch as the punched pilot hole using a pilot pin left after removing a pilot punch from a tab forming mold set of the beverage packaging lid making conversion press.

* * * * *